US009366076B2

(12) United States Patent
Hung

(10) Patent No.: US 9,366,076 B2
(45) Date of Patent: Jun. 14, 2016

(54) CORD WINDING STRUCTURE FOR WINDOW BLIND

(71) Applicant: Min-Che Hung, New Taipei (TW)

(72) Inventor: Min-Che Hung, New Taipei (TW)

( * ) Notice: Subject to any disclaimer, the term of this patent is extended or adjusted under 35 U.S.C. 154(b) by 0 days.

(21) Appl. No.: 14/477,887

(22) Filed: Sep. 5, 2014

(65) Prior Publication Data

US 2015/0136892 A1 May 21, 2015

(30) Foreign Application Priority Data

Nov. 20, 2013 (TW) ..... 102142226 A

(51) Int. Cl.
*E06B 9/30* (2006.01)
*E06B 9/322* (2006.01)

(52) U.S. Cl.
CPC ..... *E06B 9/322* (2013.01); *E06B 2009/3225* (2013.01)

(58) Field of Classification Search
CPC ..... E06B 2009/3225; E06B 9/322; E06B 2009/3222; E06B 9/60; E06B 9/56; E06B 9/262; E06B 9/38
USPC ..... 160/84.04, 84.05, 168.1 R, 170, 178.1 R, 160/178.2, 192, 173 R, 171
See application file for complete search history.

(56) References Cited

U.S. PATENT DOCUMENTS 6,330,899 B1 * 12/2001 Ciuca ..... E06B 9/32 160/170
6,508,293 B1 * 1/2003 Huang ..... E06B 9/322 160/170
6,536,503 B1 * 3/2003 Anderson ..... E06B 9/262 160/170
7,096,918 B2 * 8/2006 Lin ..... E06B 9/322 160/171
7,168,476 B2 * 1/2007 Chen ..... E06B 9/322 160/170
7,210,646 B2 * 5/2007 Hsu ..... B65H 75/48 160/170
7,281,563 B2 * 10/2007 Wu ..... E06B 9/388 160/170
7,287,569 B2 * 10/2007 Lin ..... E06B 9/303 160/170
7,287,570 B2 * 10/2007 Strand ..... E06B 9/322 160/171
7,520,311 B2 * 4/2009 Drew ..... E06B 9/322 160/171
8,002,012 B2 * 8/2011 Cheng ..... E06B 9/303 160/170
8,245,756 B2 * 8/2012 Cheng ..... E06B 9/262 160/170
8,297,332 B2 * 10/2012 Lin ..... E06B 9/322 160/170
8,820,385 B2 * 9/2014 Wu ..... E06B 9/322 160/170
8,893,763 B2 * 11/2014 Huang ..... E06B 9/322 160/170

(Continued)

FOREIGN PATENT DOCUMENTS

TW M439430 U 10/2012
TW M441020 U 11/2012
WO 2008041097 A2 4/2008

*Primary Examiner* — Katherine Mitchell
*Assistant Examiner* — Johnnie A Shablack
(74) *Attorney, Agent, or Firm* — C. G. Mersereau; Nikolai & Mersereau, P.A.

(57) ABSTRACT

A cord winding structure for window blind includes a cord winding assembly composed of a first and a second plate member, a guide rod, a first and a second shaft, a first and a second guiding wheel, and a spiral spring. The first plate member has a guide rod support bracket unit upward projected from one side thereof for supporting the guide rod thereon. The second plate member has a plurality of pulley sets provided thereon. The first and second guiding wheels are rotatably connected to between the first and the second plate member via the first and the second shaft, respectively. The spiral spring is fitted to one side of the second guiding wheel with an end extended to fasten to the first guiding wheel. A first cord is wound around the guide rod, the pulley sets and a first cord receiving groove of the first guiding wheel.

8 Claims, 9 Drawing Sheets

(56) References Cited

U.S. PATENT DOCUMENTS 8,899,298 B2 * 12/2014 Hsueh Cheng ..... E06B 9/80 160/170
8,925,615 B2 * 1/2015 Lin ..... E06B 9/322 160/170
9,004,139 B2 * 4/2015 Wu ..... E06B 9/262 160/167 R
2004/0129390 A1 * 7/2004 Toti ..... E06B 9/322 160/170
2007/0151675 A1 * 7/2007 Nien ..... E06B 9/30 160/84.05
2007/0163727 A1 * 7/2007 Cheng ..... E06B 9/30 160/170
2008/0083509 A1 * 4/2008 Hsu ..... E06B 9/32 160/84.05
2008/0083512 A1 * 4/2008 Hsu ..... E06B 9/322 160/170
2008/0185109 A1 * 8/2008 Lin ..... E06B 9/262 160/170
2008/0202705 A1 * 8/2008 Cheng ..... E06B 9/30 160/170
2008/0216967 A1 * 9/2008 Liang ..... E06B 9/326 160/168.1 V
2008/0277076 A1 * 11/2008 Cheng ..... E06B 9/322 160/167 R
2009/0205793 A1 * 8/2009 Cheng ..... E06B 9/322 160/405
2010/0206492 A1 * 8/2010 Shevick ..... E06B 9/30 160/170
2011/0061823 A1 * 3/2011 Lin ..... E06B 9/262 160/340
2011/0247766 A1 * 10/2011 Hu ..... E06B 9/322 160/188
2012/0032019 A1 * 2/2012 Chen ..... E06B 9/322 242/378
2012/0061502 A1 * 3/2012 Chen ..... E06B 9/322 242/372
2012/0097349 A1 * 4/2012 Chen ..... E06B 9/322 160/371
2013/0312919 A1 * 11/2013 Hsu ..... E06B 9/30 160/170
2013/0313497 A1 * 11/2013 Hsu ..... E06B 9/262 254/394
2014/0048217 A1 * 2/2014 Hsu ..... E06B 9/303 160/173 R
2014/0048499 A1 * 2/2014 Hsu ..... E06B 9/322 211/45
2014/0166216 A1 * 6/2014 Hsu ..... E06B 9/262 160/84.03
2014/0224431 A1 * 8/2014 Lin ..... A47H 5/032 160/84.01
2014/0291431 A1 * 10/2014 Huang ..... E06B 9/322 242/372
2015/0136336 A1 * 5/2015 Huang ..... E06B 9/322 160/170
2015/0136892 A1 * 5/2015 Hung ..... E06B 9/322 242/397.5
2015/0176329 A1 * 6/2015 Chen ..... E06B 9/322 160/176.1 R

* cited by examiner

CORD WINDING STRUCTURE FOR WINDOW BLIND

This application claims the priority benefit of Taiwan patent application number 102142226 filed on Nov. 20, 2013.

FIELD OF THE INVENTION

The present invention relates to a window blind, and more particularly to a cord winding structure for window blind that has lower use cost and allows cords of the window blind to be released or rewound smoothly without the risk of becoming tangled easily.

BACKGROUND OF THE INVENTION

A window blind is mounted on a window to block sun light from directly entering a room and therefore makes the room more comfortable. When the light in the room is insufficient, the window blind can be opened to increase the brightness in the room. Further, the window blind can also be used to protect the users' privacy and decorate the room.

Conventionally, a window blind includes a blind, a transmission unit, and a plurality of cords. The transmission unit is located on a top of the blind and is connected to the cords, and the blind is connected to the cords via the transmission unit. A user can pull and control the cords for the blind to open or close in response to the movements of the transmission unit and the cords. While the conventional window blind provides the effect of adjusting indoor brightness, it has a problem in operation. Since the cords of the conventional window blind are connected to the transmission unit and the blind is connected to the cords via the transmission unit, the user has to pull the cords to open or close the blind. In the event the user pulls the cords with an excessive force or releases the cords too quickly, the blind might not be accurately stopped at the user's desired position. The user might have to pull the cords several times before the blind can be opened or closed to the desired position. Therefore, the conventional window blind has poor convenience in use.

Further, when the user intends to open or close the blind but applies an uneven force to pull the cords, the cords connected to the transmission unit tend to become tangled and could not be pulled smoothly. Therefore, additional cord accessories are needed to control the cords or prevent the cords from tangling, resulting in increased use cost of the conventional window blind.

Therefore, the conventional window blind has the following disadvantages: (1) high use cost; (2) poor convenience in use; and (3) tending to cause tangled cords and accordingly unsmooth releasing and rewinding of the cords.

It is therefore tried by the inventor to develop an improved cord winding structure for window blind to overcome the drawbacks of the conventional window blind.

SUMMARY OF THE INVENTION

A primary object of the present invention is to provide a cord winding structure for window blind that enables lower use cost.

Another object of the present invention is to provide a cord winding structure for window blind that has high convenience in use and allows cords of the window blind to be released or rewound smoothly without the risk of becoming tangled easily.

To achieve the above and other objects, the cord winding structure for window blind according to a preferred embodiment of the present invention includes a cord winding assembly composed of a first plate member, a guide rod, a second plate member, a first shaft, a second shaft, a first guiding wheel, a second guiding wheel, a spiral spring, and a first cord.

The first plate member is provided with a guide rod support bracket unit, which is upward projected from one side of the first plate member, and a first hole set. The guide rod is provided with a plurality of holes that radially extend through the guide rod, and is rotatably rested on the guide rod support bracket unit. The second plate member is provided with a plurality of pulley sets, which are located on one side of the second plate member facing toward the first plate member, and a second hole set. The first shaft has two ends separately engaged with the first and the second hole set to thereby connect to the first and the second plate member. The second shaft has two ends separately engaged with the first and the second hole set to thereby connect to the first and the second plate member. The first guiding wheel has a first cord receiving groove, a top portion and a first shaft hole; the first shaft hole axially extends through the first guiding wheel and is rotatably fitted around the first shaft. The second guiding wheel has a first receiving space and a second shaft hole; the second shaft hole axially extends through the second guiding wheel and is rotatably fitted around the second shaft. The first spiral spring is fitted in the first receiving space of the second guiding wheel with an end fixedly connected to the second guiding wheel and another end extended to fasten to the first guiding wheel. The first cord is wound around the guide rod, the pulley sets, and the first cord receiving groove. By providing the upward projected guide rod support bracket unit on the first plate member to support the guide rod thereon, the cord winding structure for window blind according to the present invention can have lower use cost and high convenience in use, and allows the cord to be smoothly released or rewound without the risk of becoming tangled easily.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
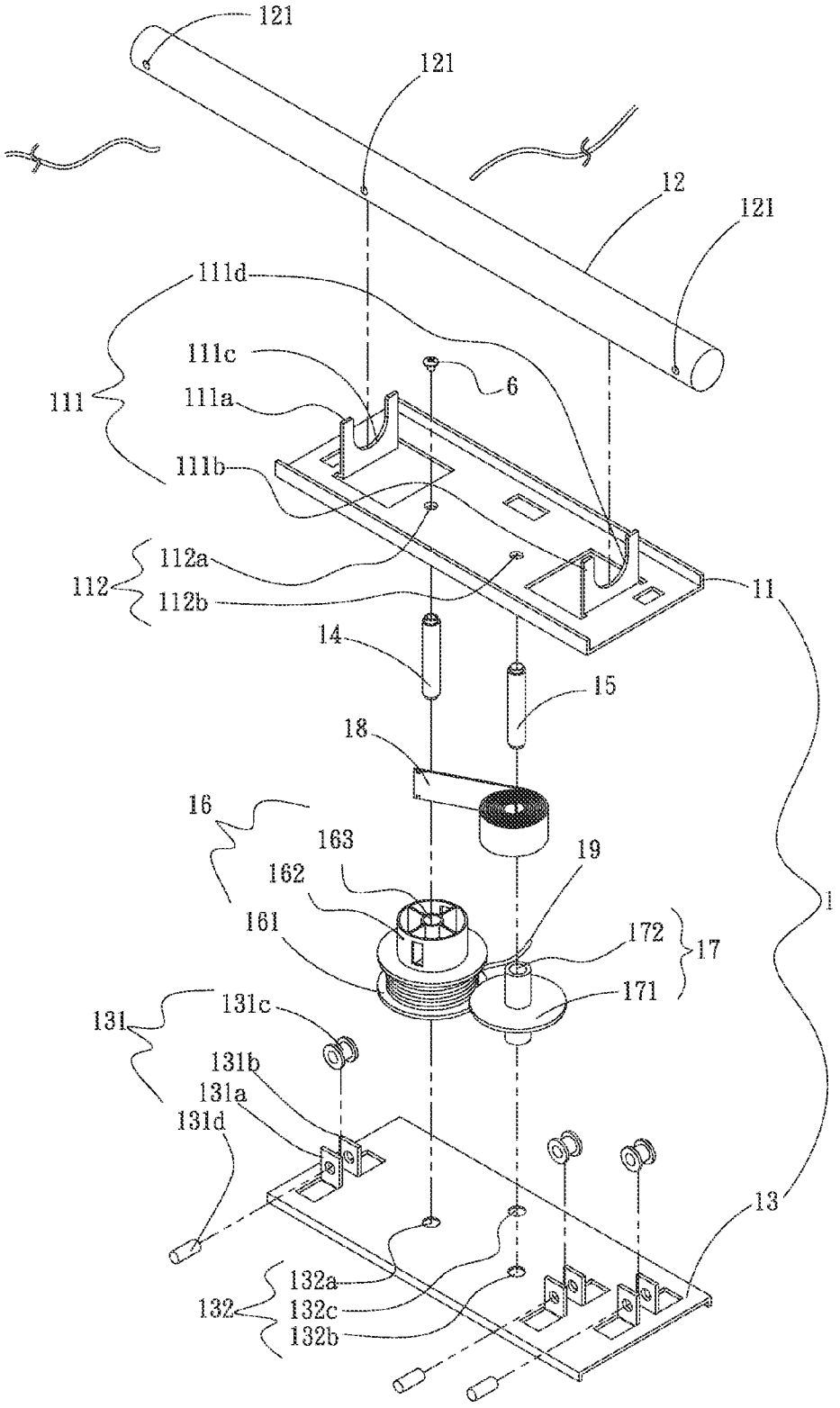
FIG. 1A is an exploded perspective view of a cord winding structure for window blind according to a first preferred embodiment of the present invention.

The present invention will now be described with some preferred embodiments thereof and by referring to the accompanying drawings. For the purpose of easy to understand, elements that are the same in the preferred embodiments are denoted by the same reference numerals.

Figure 1B:
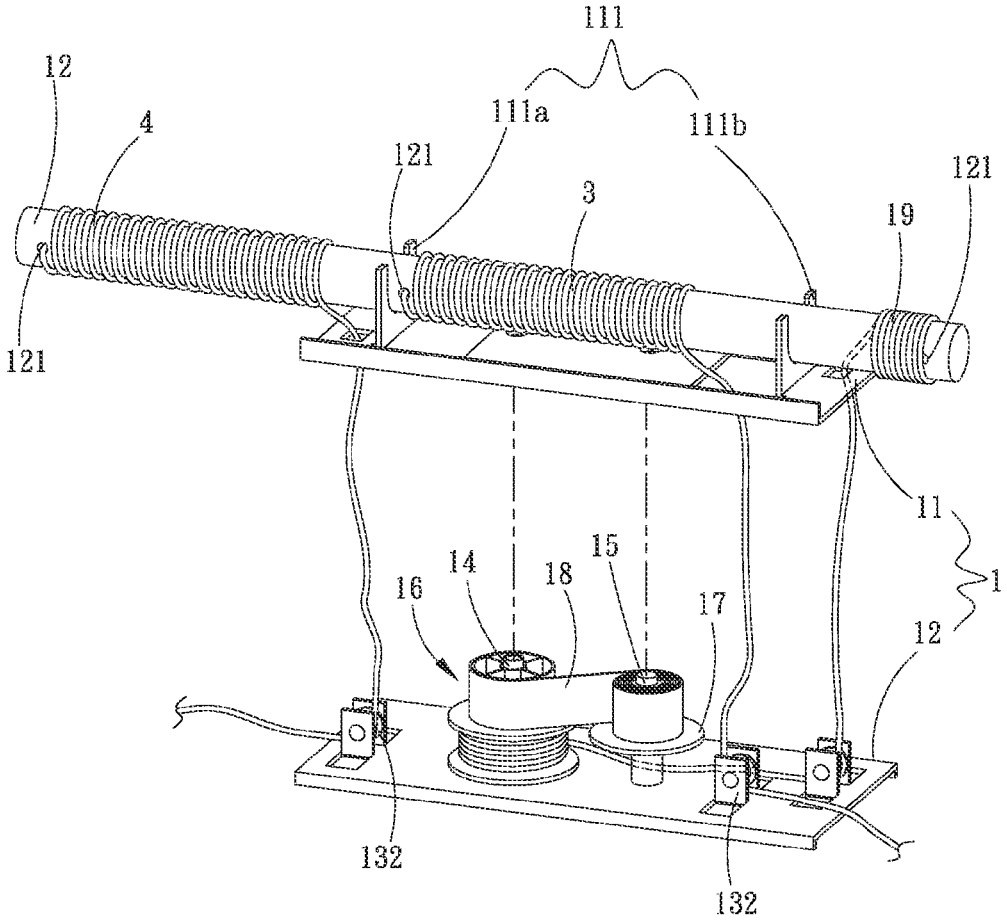
FIG. 1B is a partially assembled perspective view of FIG. 1A.
Figure 1C:
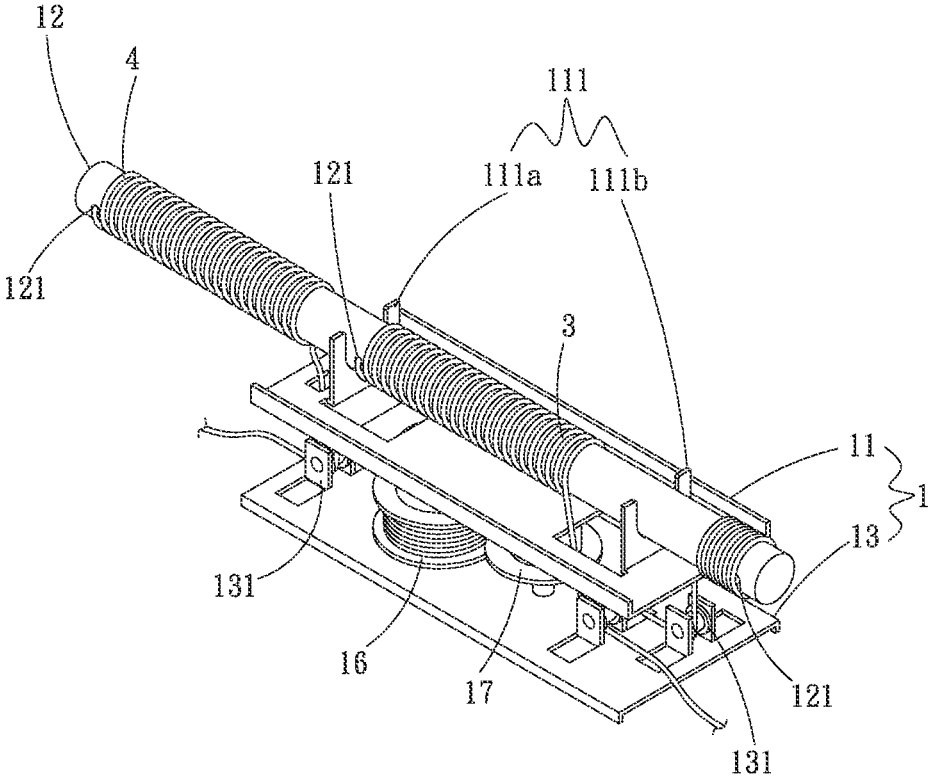
FIG. 1C is a fully assembled perspective view of FIG. 1A.

Please refer to FIGS. 1A, 1B and 1C that are exploded, partially assembled and fully assembled perspective views, respectively, of a cord winding structure for window blind according to a first preferred embodiment of the present invention. As shown, the present invention includes a cord winding assembly 1.

The cord winding assembly 1 is composed of a first plate member 11, a guide rod 12, a second plate member 13, a first shaft 14, a second shaft 15, a first guiding wheel 16, a second guiding wheel 17, a first spiral spring 18, and a first cord 19.

The first plate member 11 is provided with a guide rod support bracket unit 111, which is upward projected from one side of the first plate member 11, and a first hole set 112.

The guide rod support bracket unit 111 includes a first guide rod support bracket 111*a* and a second guide rod support bracket 111*b*, which are upward projected from one side of the first plate member 11 and are respectively provided with a first receiving recess 111*c* and a second receiving recess 111*d*. The guide rod 12 is rested in the first and second receiving recesses 111*c*, 111*d*.

The first hole set 112 includes a first hole 112*a* and a second hole 112*b*.

The guide rod 12 is provided with a plurality of spaced holes 121, which radially extend through the guide rod 12. Further, the guide rod 12 is rotatably rested on the first and the second guide rod support brackets 111*a*, 111*b* of the guide rod support bracket unit 111.

On one side of the second plate member 13 facing toward the first plate member 11, there are provided a plurality of pulley sets 131 and a second hole set 132. The second hole set 132 includes a third hole 132*a*, a fourth hole 132*b*, and a fifth hole 132*c*. The pulley sets 131 respectively include a first pulley support 131*a*, a second pulley support 131*b*, a pulley 131*c* and a pulley axle 131*d*. The first and the second pulley support 131*a*, 131*b* are located corresponding to each other, and the pulley 131*c* is rotatably mounted on the first and second pulley supports 131*a*, 131*b* via the pulley axle 131*d*.

The first shaft 14 and the second shaft 15 both have two opposite ends engaged with the first hole set 112 on the first plate member 11 and the second hole set 132 on the second plate member 13, so as to connect to the first and the second plate member 11, 13. More specifically, the first and the second shaft 14, 15 have an end inserted in the third and the fourth hole 132*a*, 132*b*, respectively, and fixedly connected to the second plate member 13 by riveting.

The first and the second shaft 14, 15 have another opposite end correspondingly inserted in the first and the second hole 112*a*, 112*b* on the first plate member 11, respectively. And, the first shaft 14 is fixedly connected to the first plate member 11 via a screw element 6, which is extended through the first hole 112*a* to screw to the end of the first shaft 14 that is engaged with the first hole 112*a*.

The first guiding wheel 16 includes a first cord receiving groove 161, a top portion 162, and a first shaft hole 163. The first shaft hole 163 axially extends through the first guiding wheel 16 and is rotatably fitted around the first shaft 14.

The second guiding wheel 17 includes a first receiving space 171 and a second shaft hole 172. The second shaft hole 172 axially extends through the second guiding wheel 17 and is rotatably fitted around the second shaft 15. The first spiral spring 18 is fitted in the first receiving space 171 of the second guiding wheel 17, and has an end fixedly connected to the second guiding wheel 17 and another end extended to fasten to the first guiding wheel 16.

The first cord 19 is wound around the guide rod 12, the pulley sets 131 and the first cord receiving groove 161. The first cord 19 has an end extended through one of the holes 121 formed on the guide rod 12 and another end fixedly connected to the first cord receiving groove 161 of the first guiding wheel 16.

Figure 2:
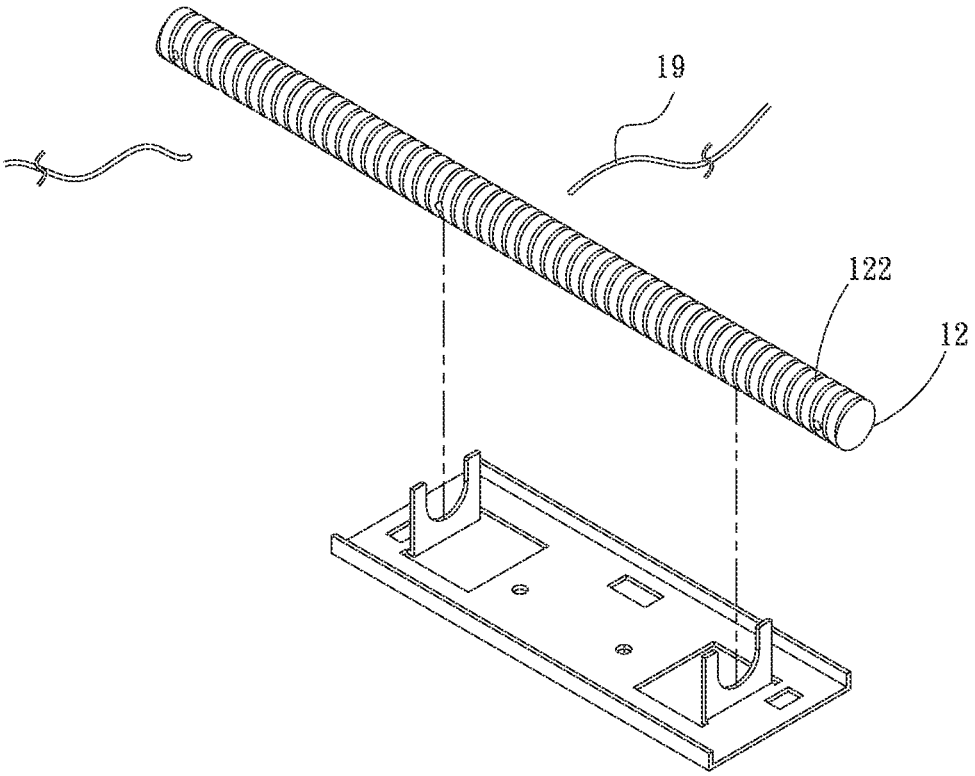
FIG. 2 is a perspective view showing the manner of assembling a cord winding structure for window blind according to a second preferred embodiment of the present invention.

FIG. 2 shows the manner of assembling a cord winding structure for window blind according to a second preferred embodiment of the present invention. The second preferred embodiment is generally structurally similar to the first one, except that the guide rod 12 thereof further has a plurality of screw threads 122 formed thereon. The screw threads 122 are axially extended on an outer surface of the guide rod 12, allowing the first cord 19 to wind around the guide rod 12 along the screw threads 122.

Figure 3:
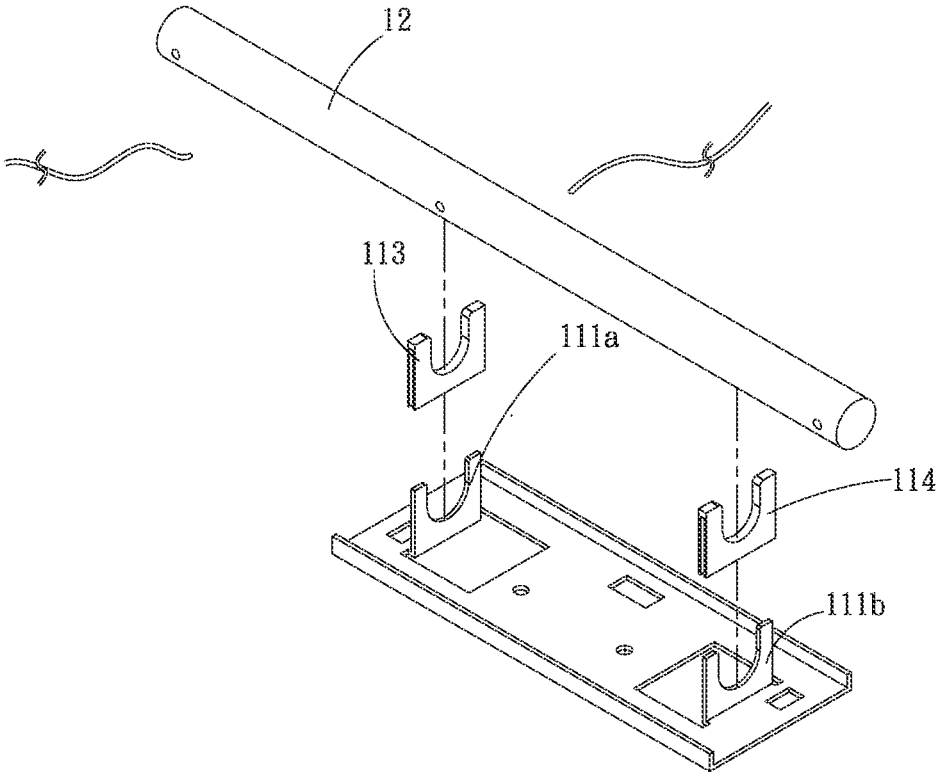
FIG. 3 is a perspective view showing the manner of assembling a cord winding structure for window blind according to a third preferred embodiment of the present invention.

FIG. 3 shows the manner of assembling a cord winding structure for window blind according to a third preferred embodiment of the present invention. The third preferred embodiment is generally structurally similar to the first one, except that the guide rod support bracket unit 111 thereof further includes a first slide jacket 113 and a second slide jacket 114, which are fitted over the first guide rod support bracket 111*a* and the second guide rod support bracket 111*b*, respectively, to reduce wear of the guide rod 12 and the first and second guide rod support brackets 111*a*, 111*b* and to avoid producing noise when the guide rod 12 rotates on the first and second guide rod support brackets 111*a*, 111*b*.

Figure 4:
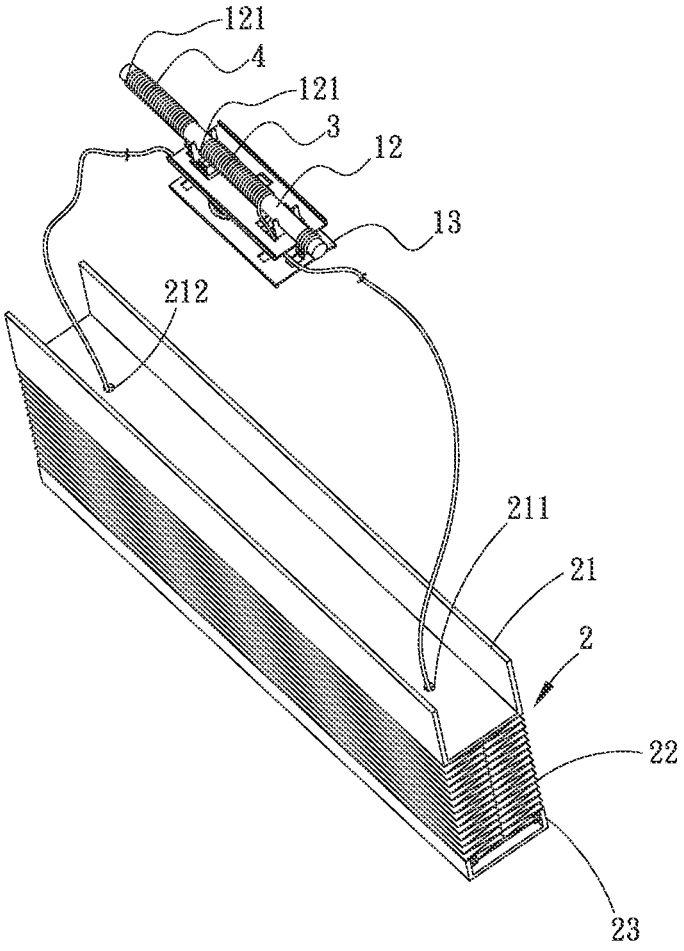
FIG. 4 is a partially assembled perspective view of a cord winding structure for window blind according to a fourth preferred embodiment of the present invention.

FIG. 4 shows a cord winding structure for window blind according to a fourth preferred embodiment of the present invention in a partially assembled state. The fourth preferred embodiment is generally structurally similar to the first one, except that the second plate member 13 thereof is connected at another side opposite to the first plate member 11 to a window blind main body 2. The window blind main body 2 includes a head rail 21, a blind 22 connected to below the head rail 21, and a bottom rail 23 connected to below the blind 22. The head rail 21 is provided with a first opening 211 and a second opening 212, which extend through the head rail 21. A second cord 3 has an end extended through one of the holes 121 formed on the guide rod 12 to connect to the guide rod 12, the rest part of the second cord 3 is wound around the guide rod 12 with another end of the second cord 3 extending through the first opening 211 formed on the head rail 21 to connect to the bottom rail 23. A third cord 4 has an end extended through another one of the holes 121 formed on the guide rod 12 to connect to the guide rod 12, the rest part of the third cord 4 is wound around the guide rod 12 with another end of the third cord 4 extending through the second opening 212 formed on the head rail 21 to connect to the bottom rail 23. The second plate member 13 is connected to the head rail 21 by riveting.

Figure 5:
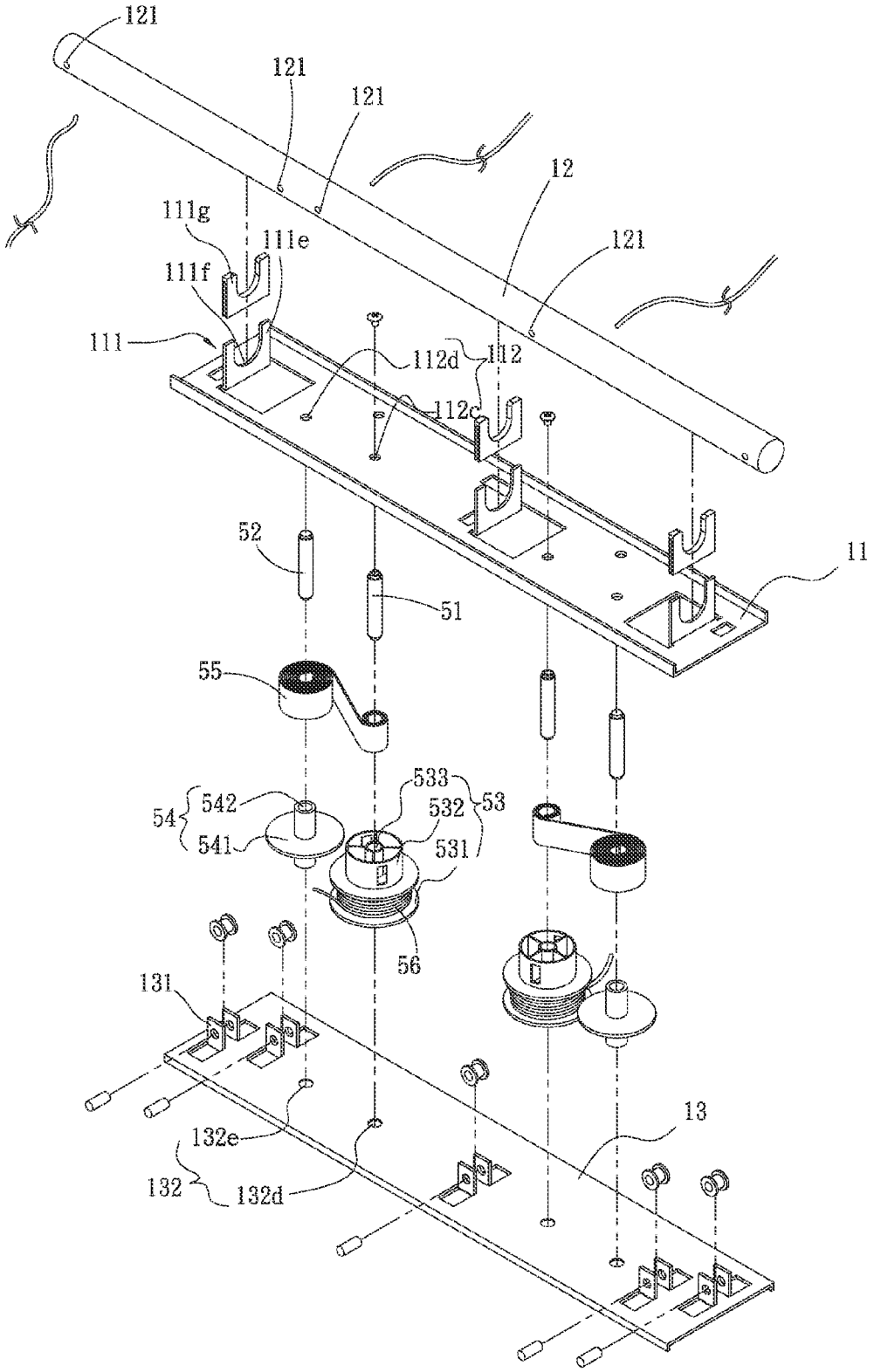
FIG. 5 is an exploded perspective view of a cord winding structure for window blind according to a fifth preferred embodiment of the present invention.
Figure 6:
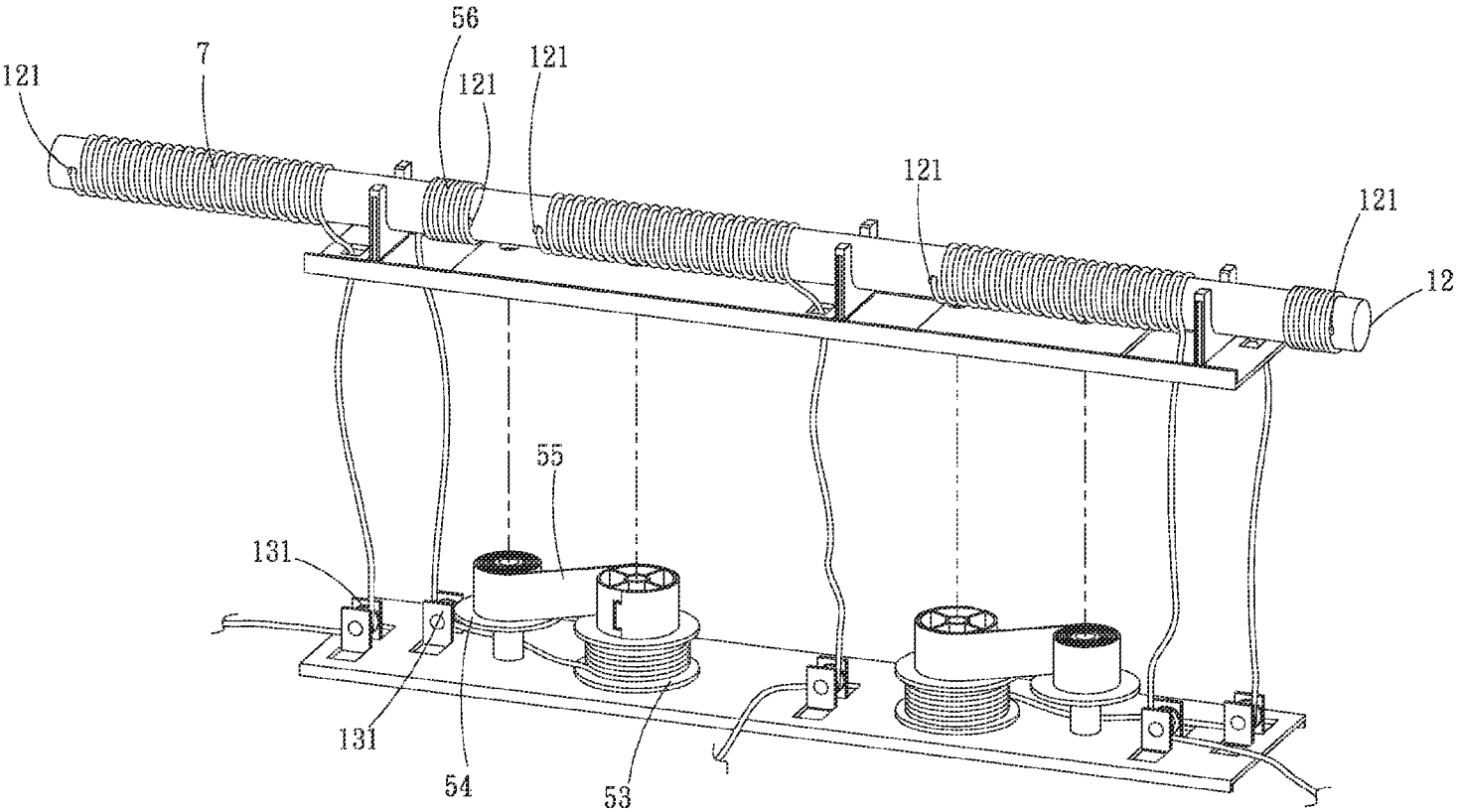
FIG. 6 is a partially assembled perspective view of FIG. 5.
Figure 7:
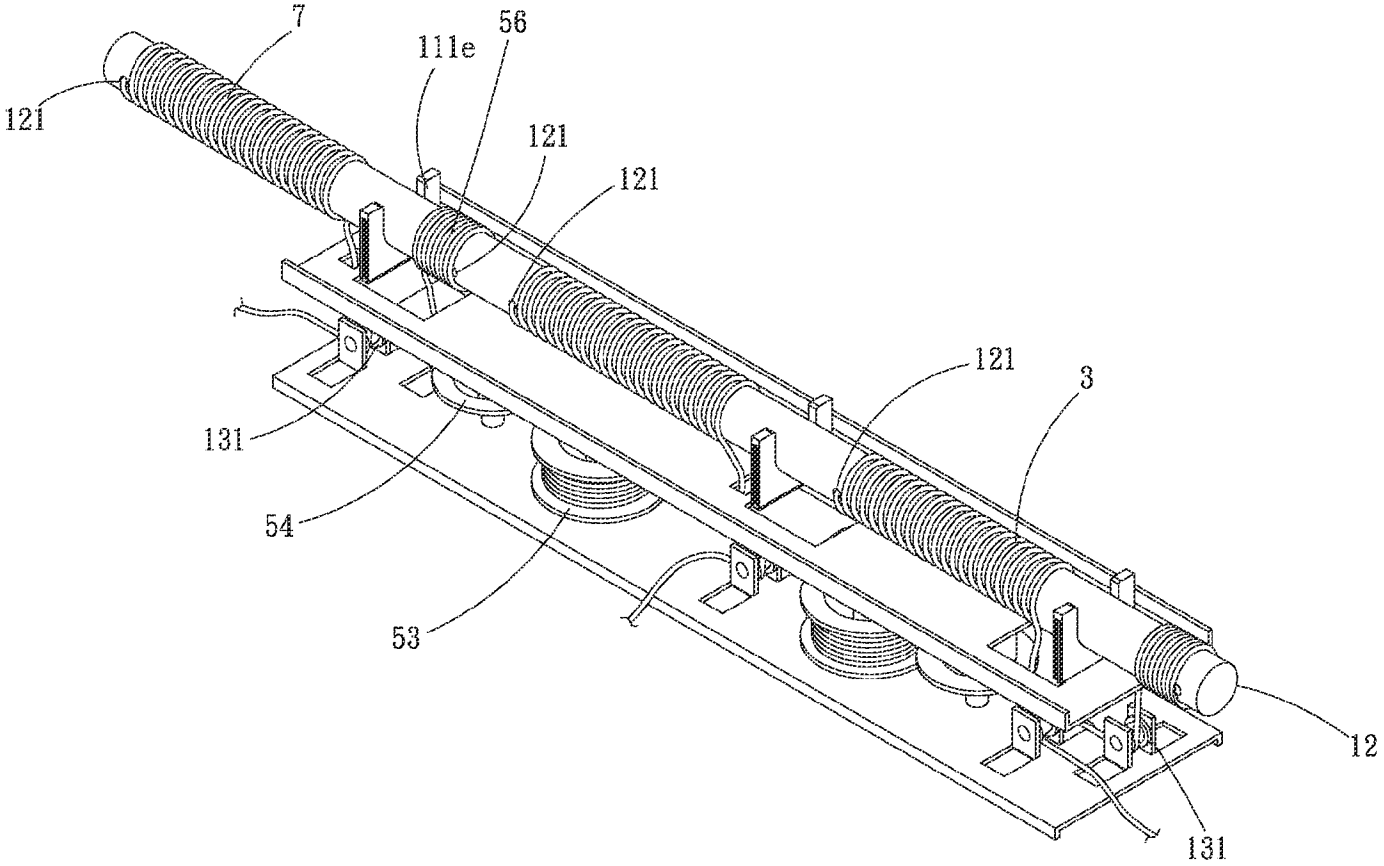
FIG. 7 is a fully assembled perspective view of FIG. 5.

Please refer to FIGS. 5, 6 and 7 that are exploded, partially assembled and fully assembled perspective views, respectively, of a cord winding structure for window blind according to a fifth preferred embodiment of the present invention. The fifth preferred embodiment is generally structurally similar to the first one but further includes a third shaft 51, a fourth shaft 52, a third guiding wheel 53, a fourth guiding wheel 54, a second spiral spring 55, a fourth cord 56, and a fifth cord 7. The third shaft has two ends engaged with the first and the second hole set 112, 132 on the first and the second plate member 11, 13, respectively, to thereby connect to the first and second plate members 11, 13. The fourth shaft 52 has two ends engaged with the first and the second hole set 112, 132 on the first and the second plate member 11, 13, respectively, to thereby connect to the first and second plate members 11, 13. The third guiding wheel 53 includes a second cord receiving groove 531, a top portion 532 and a third shaft hole 533. The third shaft hole 533 axially extends through the third guiding wheel 53 and is rotatably fitted around the third shaft 51. The fourth guiding wheel 54 includes a second receiving space 541 and a fourth shaft hole 542. The fourth shaft hole 542 axially extends through the fourth guiding wheel 54 and is rotatably fitted around the fourth shaft 52. The second spiral spring 55 is fitted in the second receiving space 541 of the fourth guiding wheel 54, and has an end fixedly connected to the fourth guiding wheel 54 and another end extended to fasten to the third guiding wheel 53. The fourth cord 56 is wound around the guide rod 12, the pulley sets 131 and the second cord receiving groove 531. The fifth cord 7 is wound around the guide rod 12 and the pulley sets 131.

In the fifth preferred embodiment, the guide rod support bracket unit 111 further includes a third guide rod support bracket 111*e* upward projected from one side of the first plate member 11 and located adjacent to the first and second guide rod support brackets 111*a*, 111*b*. The third guide rod support bracket 111*e* is provided with a third receiving recess 111*f*. The guide rod 12 is rested in the first, second and third receiving recesses 111*c*, 111*d*, 111*f*.

In the fifth preferred embodiment, the first hole set 112 further includes a sixth hole 112*c* and a seventh hole 112*d*; and the second hole set 132 further includes an eighth hole 132*d* and a ninth hole 132*e*. The third and the fourth shaft 51, 52 have an end inserted in the eighth and the ninth hole 132*d*, 132*e*, respectively, and fixedly connected to the second plate member 13 by riveting. The third and the fourth shaft 51, 52 have another opposite end correspondingly inserted in the sixth and the seventh hole 112*c*, 112*d* on the first plate member 11, respectively. And, the third shaft 51 is fixedly connected to the first plate member 11 via a screw element 6, which is extended through the sixth hole 112*c* to screw to the end of the third shaft 51 that is engaged with the sixth hole 112*c*.

In the fifth preferred embodiment, the guide rod support bracket unit 111 further includes a third slide jacket 111*g*, which is fitted over the third guide rod support bracket 111*e*.

As can be seen from FIGS. 1 to 7, in all the first to fifth preferred embodiments of the present invention, the first cord 19 wound around the first guiding wheel 16 brings the guide rod 12 to rotate while the rotating of the first guiding wheel 16 is controlled by a spring force of the first spiral spring 18. Referring to the fourth preferred embodiment shown in FIG. 4, both of the second cord 3 and the third cord 4 are connected at two ends to the bottom rail 23 of the window blind main body 2 and the guide rod 12, and have a portion wound around the guide rod 12. When the bottom rail 23 is moved downward, it pulls the second and third cords 3, 4 and accordingly, brings the guide rod 12 to rotate. At this point, the first cord 19 is pulled out of the first cord receiving groove 161 of the first guiding wheel 16 and wound around the guide rod 12. On the other hand, when the bottom rail 23 is moved upward, the first cord 19 is rewound onto the first cord receiving groove 161 while the second cord 3 and the third cord 4 are rewound onto the guide rod 12. That is, the first cord 19 is wound around the guide rod 12 in a direction opposite to that in which the second and third cords 3, 4 are wound around the guide rod 12. The operation of the fifth preferred embodiment of the present invention is the same as that of the fourth preferred embodiment, and is therefore not repeatedly described herein.

As can be seen in the drawings, the first and the second plate member 11, 13 are provided on areas immediately adjacent to the structures upward projected from the first and the second plate member 11, 13, such as the guide rod support bracket unit 111, the first pulley support 131*a* and the second pulley support 131*b*, with openings having sizes the same as or closed to that of the corresponding projected structures. The first, the second and the third cord 19, 3, 4 respectively have an end extended through selected ones of these openings, and can therefore be more smoothly rewound onto or released from the guide rod 12.

In brief, the cord winding structure for window blind according to the present invention is superior to the prior art due to the following advantages: (1) lower use cost; (2) high convenience in use; and (3) allowing cords of the window blind to be released or rewound smoothly without the risk of becoming tangled easily.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A cord winding structure for a window blind, comprising a cord winding assembly comprising:

a first plate member being provided with a guide rod support bracket unit, which is upward projected from one side of the first plate member, and a first hole set;

a guide rod being provided with a plurality of holes that radially extend through the guide rod, and being rotatably rested on the guide rod support bracket unit;

a second plate member being provided with a plurality of first pulley sets, which are located on one side of the second plate member facing toward the first plate member, and a second hole set;

a first shaft having two ends separately engaged with a first hole of each of the first and the second hole set to thereby connect to the first plate member and the second plate member;

a second shaft having two ends separately engaged with a second hole of the first and the second hole set to thereby connect to the first plate member and the second plate member;

a first guiding wheel having a first cord receiving groove, a top portion and a first shaft hole; the first shaft hole axially extending through the first guiding wheel, the first guiding wheel being rotatably mounted on the first shaft;

a second guiding wheel having a first receiving space and a second shaft hole; the second shaft hole axially extending through the second guiding wheel the second guiding wheel being rotatably mounted on the second shaft;

a first spiral spring being fitted in the first receiving space of the second guiding wheel with an end fixedly connected to the second guiding wheel and another end extended to fasten to the first guiding wheel; and a first cord being wound around the guide rod, the first pulley sets, and the first cord receiving groove;

wherein the guide rod support bracket unit includes a first guide rod support bracket and a second guide rod support bracket upward projected from one side of the first plate member; the first and the second guide rod support bracket being provided with a first receiving recess and a second receiving recess, respectively; and the guide rod being rested in the first and second receiving recesses; and wherein the guide rod support bracket unit further includes a first slide jacket and a second slide jacket fitted over the first and the second guide rod support bracket, respectively.

2. The cord winding structure for window blind as claimed in claim 1, wherein the first cord has an end extended through one of the holes on the guide rod and another end fixedly connected to the first cord receiving groove of the first guiding wheel.

3. The cord winding structure for window blind as claimed in claim 1, wherein the first hole set includes a first hole and a second hole, and the second hole set includes a third hole, a fourth hole and a fifth hole; the first and the second shaft having an end inserted in the third and the fourth hole, respectively, and fixedly connected to the second plate member by riveting; the first and the second shaft having another end inserted in the first and the second hole on the first plate member; and, the first shaft being fixedly connected to the first plate member via a screw element, which is extended through the first hole to screw to the end of the first shaft that is engaged with the first hole.

4. The cord winding structure for window blind as claimed in claim 1, wherein the guide rod is provided with a plurality of screw threads axially extended on an outer surface of the guide rod; and the first cord being wound around the guide rod along the screw threads.

5. The cord winding structure for window blind as claimed in claim 1, wherein the second plate member is connected at another side opposite to the first plate member to a window blind main body; the window blind main body including a head rail, a blind connected to below the head rail, and a bottom rail connected to below the blind, the head rail being provided with a first opening and a second opening, which extend through the head rail; the window blind further including a second cord and a third cord; the second cord having an end extended through one of the holes formed on the guide rod to connect to the guide rod with the remainder of the second cord being wound around the guide rod with another end of the second cord extending through the first opening formed on the head rail to connect to the bottom rail; and the third cord having an end extended through another one of the holes formed on the guide rod to connect to the guide rod while the rest part of the third cord being wound around the guide rod with another end of the third cord extending through the second opening formed on the head rail to connect to the bottom rail.

6. The cord winding structure for window blind as claimed in claim 1, wherein the first pulley sets respectively include a first pulley support, a second pulley support, a pulley and a pulley axle; the first and the second pulley support being located spaced from each other and carrying a pulley axle, and each pulley being rotatably mounted on the first and second pulley supports via the pulley axle.

7. A cord winding structure for a window blind, comprising a cord winding assembly comprising:

a first plate member being provided with a guide rod support bracket unit, which is upward projected from one side of the first plate member, and a first hole set;

a guide rod being provided with a plurality of holes that radially extend through the guide rod, and being rotatably rested on the guide rod support bracket unit;

a second plate member being provided with a plurality of first pulley sets, which are located on one side of the second plate member facing toward the first plate member, and a second hole set;

a first shaft having two ends separately engaged with a first hole of each of the first and the second hole set to thereby connect to the first plate member and the second plate member;

a second shaft having two ends separately engaged with a second hole of the first and the second hole set to thereby connect to the first plate member and the second plate member;

a first guiding wheel having a first cord receiving groove, a top portion and a first shaft hole; the first shaft hole axially extending through the first guiding wheel, the first guiding wheel being rotatably mounted on the first shaft;

a second guiding wheel having a first receiving space and a second shaft hole; the second shaft hole axially extending through the second guiding wheel the second guiding wheel being rotatably mounted on the second shaft;

a first spiral spring being fitted in the first receiving space of the second guiding wheel with an end fixedly connected to the second guiding wheel and another end extended to fasten to the first guiding wheel;

a first cord being wound around the guide rod, the first pulley sets, and the first cord receiving groove;

a third shaft having two ends engaged with third holes of the first and the second hole set on the first and the second plate member, respectively, to thereby connect to the first and second plate members;

a fourth shaft having two ends engaged with fourth holes of the first and the second hole set on the first and the second plate member, respectively, to thereby connect to the first and second plate members;

a third guiding wheel including a second cord receiving groove, a top portion and a third shaft hole; and the third shaft hole axially extending through the third guiding wheel, the third guiding wheel being rotatably mounted on the third shaft;

a fourth guiding wheel including a second receiving space and a fourth shaft hole; and the fourth shaft hole axially extending through the fourth guiding wheel, the fourth guiding wheel being rotatably mounted on the fourth shaft;

a second spiral spring being fitted in the second receiving space of the fourth guiding wheel with an end fixedly connected to the fourth guiding wheel and another end extended to fasten to the third guiding wheel;

a fourth cord being wound around the guide rod, the pulley sets and the second cord receiving groove;

a fifth cord being wound around the guide rod and the pulley sets; and wherein the first hole set further includes a sixth hole and a seventh hole, and the second hole set further includes an eighth hole and a ninth hole; the third and the fourth shaft having one end inserted in the eighth hole and the ninth hole, respectively, and fixedly connected to the second plate member by riveting; the third and the fourth shaft having another end inserted in the sixth hole and the seventh hole, respectively; and a screw element being extended through the sixth hole to screw to the end of the third shaft that is inserted in the sixth hole to thereby fixedly connect the third shaft to the first plate member.

8. A cord winding structure for a window blind, comprising a cord winding assembly comprising:

a first plate member being provided with a guide rod support bracket unit, which is upward projected from one side of the first plate member, and a first hole set;

a guide rod being provided with a plurality of holes that radially extend through the guide rod, and being rotatably rested on the guide rod support bracket unit;

a second plate member being provided with a plurality of first pulley sets, which are located on one side of the second plate member facing toward the first plate member, and a second hole set;

a first shaft having two ends separately engaged with a first hole of each of the first and the second hole set to thereby connect to the first plate member and the second plate member;

a second shaft having two ends separately engaged with a second hole of the first and the second hole set to thereby connect to the first plate member and the second plate member;

a first guiding wheel having a first cord receiving groove, a top portion and a first shaft hole; the first shaft hole axially extending through the first guiding wheel, the first guiding wheel being rotatably mounted on the first shaft;

a second guiding wheel having a first receiving space and a second shaft hole; the second shaft hole axially extending through the second guiding wheel the second guiding wheel being rotatably mounted on the second shaft;

a first spiral spring being fitted in the first receiving space of the second guiding wheel with an end fixedly connected to the second guiding wheel and another end extended to fasten to the first guiding wheel;

a first cord being wound around the guide rod, the first pulley sets, and the first cord receiving groove;

wherein the guide rod support bracket unit includes a first guide rod support bracket, a second guide rod support bracket and a third guide rod support bracket; the first, the second and the third guide rod support bracket being upward projected from one side of the first plate member and provided with a first, a second and a third receiving recess, respectively; and the guide rod being rested in the first, second and third receiving recesses; and wherein the guide rod support bracket unit further includes a first slide jacket, a second slide jacket and a third slide jacket; and the first, the second and the third slide jacket being fitted over the first, the second and the third guide rod support brackets, respectively.

* * * * *